US005368506A

United States Patent [19]

Heimbrock

[11] Patent Number: 5,368,506

[45] Date of Patent: Nov. 29, 1994

[54] ELECTRIC STREET LIGHT TERMINAL BLOCK ASSEMBLY

[75] Inventor: H. Howard Heimbrock, Lawrenceburg, Ind.

[73] Assignee: Standex International Corporation, Salem, N.H.

[21] Appl. No.: 150,714

[22] Filed: Nov. 12, 1993

[51] Int. Cl.[5] ..... H01R 9/24; H01R 4/36

[52] U.S. Cl. ..... 439/813; 439/709

[58] Field of Search ..... 439/709, 810, 813, 814, 439/811, 812, 845, 849, 850, 884

[56] References Cited

U.S. PATENT DOCUMENTS

| | | | |
|---|---|---|---|
| 3,070,772 | 12/1962 | Olsson et al. | 439/814 |
| 3,715,707 | 2/1973 | Anderson | 439/814 |
| 3,775,733 | 11/1973 | Ege | 439/814 |
| 4,273,408 | 6/1981 | Orr | 439/709 |
| 4,778,231 | 10/1988 | Seidler et al. | 439/849 |

FOREIGN PATENT DOCUMENTS

| | | | |
|---|---|---|---|
| 858089 | 12/1970 | Canada | 439/814 |
| 944494 | 4/1949 | France | 439/814 |
| 2232556 | 1/1973 | Germany | 439/813 |

OTHER PUBLICATIONS

Four drawings (35-218047; 35-232195; 35-217543; and 35-218024) of a GE main Power Terminal Block (and components).

*Primary Examiner*—Gary F. Paumen

*Attorney, Agent, or Firm*—Wood, Herron & Evans

[57] ABSTRACT

A main power terminal block (10) for a street light assembly (130) includes connectors (14) having a single-gauge metal piece (20) the front of which is adapted to receive a power conductor (16), and the back of which is shaped into overly-thick and under-wide wings (62) which are then coined along at least a peripheral edge (70) to define a thinner and wider spade lug (40, 42) to receive a spade lug terminal (76) thereover. The connector (14) also includes a nut-like member (22) and bolt (24) which cooperate with a hole (116) in the insulative housing (12) to secure connector (14) within a passageway (90) of housing (12) while also electrically and mechanically securing conductor (16) within the front portion of connector (14).

46 Claims, 2 Drawing Sheets

ELECTRIC STREET LIGHT TERMINAL BLOCK ASSEMBLY

BACKGROUND OF THE INVENTION

I. Field of the Invention

The present invention relates to electric street light assemblies and, more particularly, to the main power terminal block for such electric street lights assemblies.

II. Description of Prior Art

Conventional electric street lights often come as a completed assembly to be mounted above the ground, such as on a pole. The power conductors running up through the pole may then be attached to the light assembly wiring and circuitry. To facilitate such attachment, a main power terminal block may be provided. These main power terminal blocks are quite large and bulky, and typically include an insulator block that supports two or three electrical connectors, one for each power conductor. Each conductor includes at least three parts, a base, a washer and a screw. The power conductor is squeezed between the washer and base by rotating the screw threaded therethrough. One or two spade lugs extend from the connector base to receive spade lug terminals wired to the lighting circuitry.

The connectors used in these main power terminal blocks are typically expensive to manufacture, and do not always provide the desired power connection. For example, the base is typically thicker than the spade lugs. Consequently, multi gauge brass is required. This is accomplished by milling or skiving the area of the spade lugs to reduce thickness, thus increasing the cost thereof.

Still further, it is quite common that large gauge power conductors, such as up to six gauge, might be passed up through the light pole to connect to the electric light for powering same. Such large gauge conductors present difficulties in connecting to the above-described connectors. To overcome such problems, it has been typical to provide a separate block connector having a main block and an extending plate, and which is to be mounted to the original connector. The plate is captured between the washer and base of the original connector requiring the added labor of removal and reinsertion of the screw. The main block has an aperture into which the conductor may be received with a set screw or the like passing through the block to secure the conductor in place.

While the additional block connector makes it easier to attach large gauge conductors to the main power terminal block, significant cost is added both in terms of labor and in terms of material. Additionally, the block connectors are normally of aluminum with the set screw being steel, thus presenting a variety of different metals in the terminal block, which may present additional difficulties in the environment in which these main power terminal blocks are employed.

SUMMARY OF THE INVENTION

The present invention provides an electric street light terminal block assembly which provides a more compact unit with less expensive and fewer components and yet, is adapted to handle a wide range of conductors ranging from, for example, six gauge to sixteen gauge. To this end, and in accordance with the principles of the present invention, labor cost is reduced by elimination of the milling or skiving of the spade lugs. Instead, a single gauge piece or base may be used with the spade lug initially being thicker (as thick as the rest of the base) and narrower than is desired of a spade lug. To provide the desired thickness, at least a lateral edge or peripheral portion of the lug is coined to reduce the thickness in the peripheral portion and to extend the width of the lug thereat so that the lug now has the desired thickness and width. Where opposed lateral edges are coined, a hump portion may remain therebetween to provide stiffness to the lug without interfering with the electrical connection to the conventional spade lug terminal, which includes a gap between its gripping edges.

In accordance with a further feature of the present invention, labor and material costs are further reduced by elimination of the added block connector for large gauge wire. Instead, the electrical connector includes a one-piece shaped metal member which supports a nut with a screw threaded therethrough and extending into a space in which the conductor is to be placed and secured to the one-piece metal member. More particularly, the electrical connector may be formed from one piece of single gauge metal in which a portion of the piece is shaped into a pair of upstanding walls and a bight supporting the walls defining a generally U-shaped cross section, with the walls being spaced apart to confine an electrical wire therebetween. The spade lugs may also be formed out of that single piece and then coined as above-described. Formed in each wall, spaced above the bight, is a slot with the nut inserted through the slot. A bolt or other threaded member may be threaded into the nut so that the end thereof extends into the space between the walls to compress and secure any conductor situated therein against the bight. With this configuration, a wide range of conductors may be used, including six to sixteen gauge conductors.

As a consequence, the electrical connector aspect of the main power terminal block of the present invention is provided by a less expensive single-gauge material and without the need for additional or different securement structure depending upon the gauge of the conductor to be secured thereto.

To secure the electrical connector to the insulator block, the insulator block is provided with a passageway or cavity for each connector extending into the block. The electrical connector is inserted into the passageway, such as from the front of the block, spade lug-end first. A portion of the passageway at the back end thereof is exposed so that the spade lugs are accessible to receive the spade lug terminals thereon. Also, the side walls of the passageways are provided with longitudinal grooves so that the portions of the nut sticking out from the side of the connector walls may be received therein. The top, or roof, wall of the insulator block over the passageway is provided with a hole through which the screw may be received into the nut so as to provide not only the function of securing the conductor to the connector, but also of securing the connector within the passageway.

For insertion from the front of the passageway, the insulator block may include a wall piece or similar structure adjacent the back end of the passageway floor to limit the electrical connector in its extent of travel into the passageway to ensure that the nut will align with the bolt hole in the housing roof. The wall piece structure may also include mounting holes to facilitate attaching the completed unit into the light assembly.

The resulting insulator block is much smaller and less bulky than was used in prior main power terminal blocks.

By virtue of the foregoing, there is thus provided a main power terminal block for electric street light assemblies which utilizes less expensive and fewer components and yet, has the advantage of being both compact and capable of receiving a wide range of conductors.

These and other objects and advantages of the present invention shall become more apparent from the accompanying drawings and descriptions thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

DETAILED DESCRIPTION OF THE DRAWINGS

Figure 1:
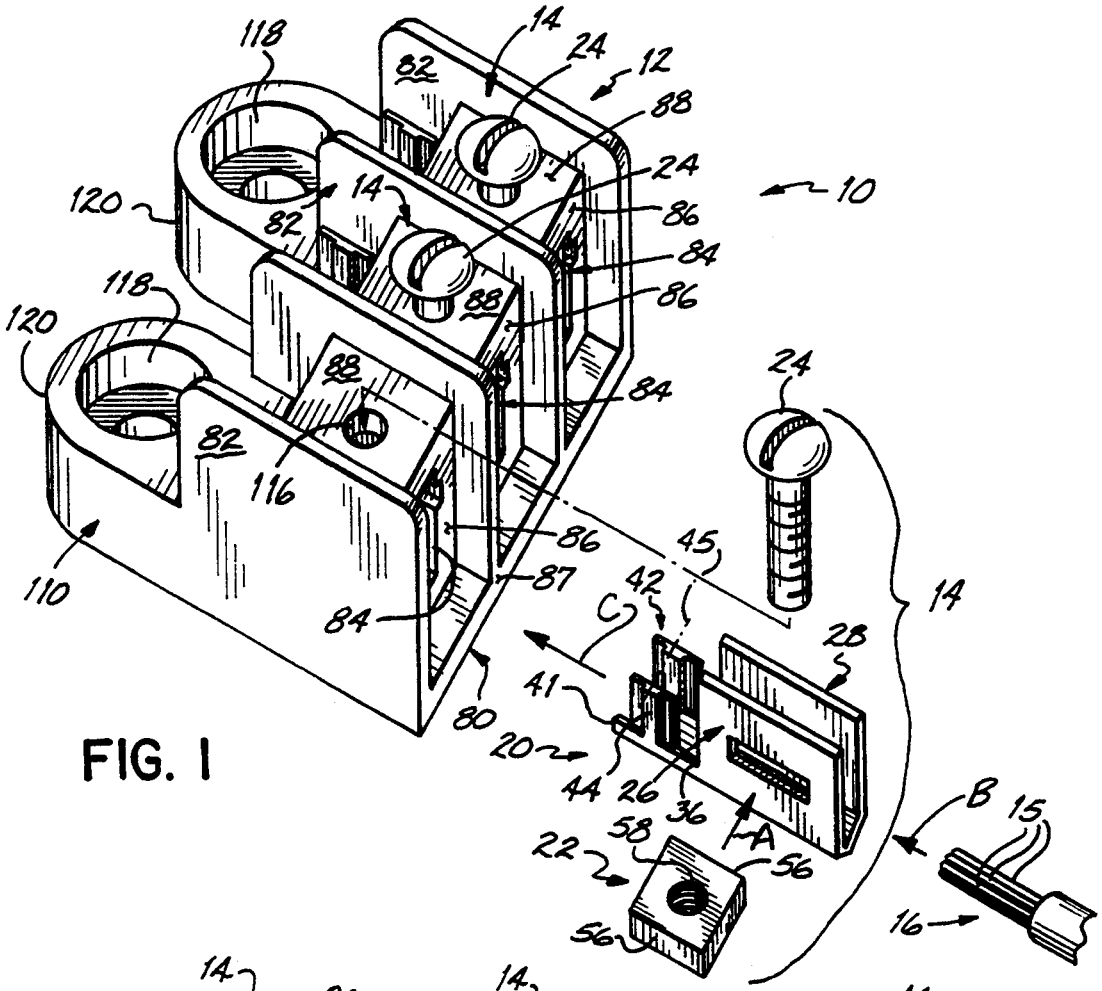
FIG. 1 is an exploded, perspective view of a main power terminal block in accordance with the principles of the present invention.
Figure 2:
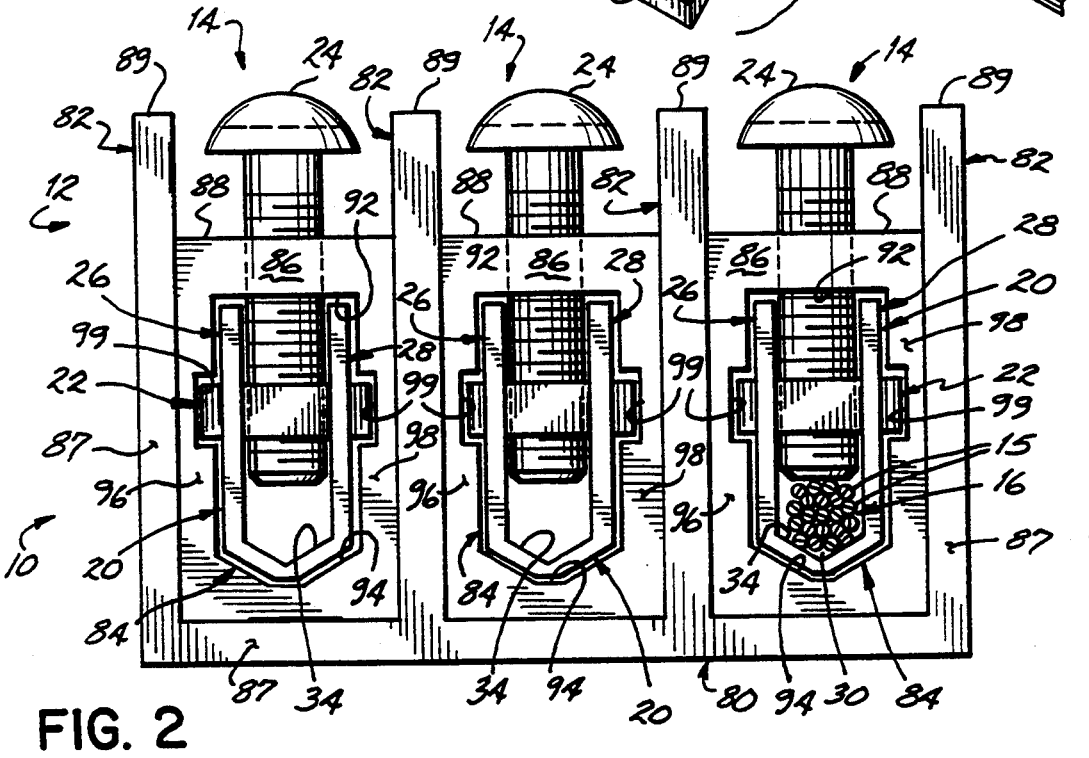
FIG. 2 is a front view of the assembled main power terminal block of FIG. 1.
Figure 4:
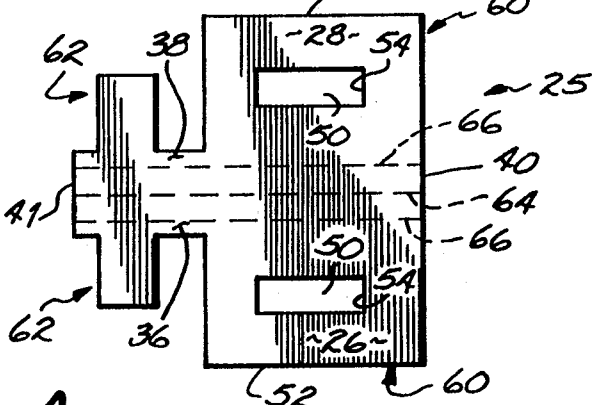
FIG. 4 is a plan top view of a single metal piece used to form the electrical connector of FIG. 3.

With reference to FIG. 1, there is shown a perspective view of a main power terminal block 10, including an insulator block or housing 12 supporting, in this embodiment, three electrical connectors 14 (although usually at least two are utilized and more could be provided as desired), each for mechanically and electrically securing therein the multiple strands or wires 15 of a power conductor 16 having a gauge typically between 6 gauge and 16 gauge (i.e., between about 0.162 inches or 4.116 mm and 0.05082 inches or 1.291 mm outer diameter). Each connector 14 is comprised of three basic components, those being generally U-shaped metal member 20, brass nut 22 and zinc-plated steel screw or bolt 24. As will be described, unitary piece 25 (FIG. 4) of single gauge metal, such as a 0.050 inch thick piece of brass, may be formed into the shape of metal member 20 seen in FIG. 1 having a first portion adapted to receive a power conductor and a second or back portion shaped to receive one or more electrical terminals. To this end, the first portion of member 20 includes a pair of about 0.469 inch tall upstanding walls 26, 28, which are spaced apart about 0.190 inches to confine the wires 15 of conductor 16 therebetween as at 30 (FIG. 2). Walls 26, 28 are supported on about 0.156 inch tall bight portion 34 which is defined by bight walls 36, 38. Walls 26, 28 extend from front edge 40 of member 20 rearwardly about 0.750 inches. Bight portion 34 is about 1.187 inches long and extends rearwardly beyond walls 26, 28 to support at the distal end 41 thereof a pair of spade lugs 42, 44 which are also formed from single piece 25 previously mentioned. The centerline 45 of each lug 42, 44 is positioned about 1.0 inch from front edge 40 of connector 14.

To secure conductor 16 between walls 26, 28, nut 22 and bolt 24 are provided. To hold nut 22 to member 20, a slot 50 is formed extending completely through each of walls 26, 28. Slots 50 are sized to receive nut 22 sideways therethrough along the direction of arrow A in FIG. 1. To this end, slots 50 may be approximately $\frac{1}{8}$ inch high by $\frac{3}{8}$ inch long and spaced about 0.187 inch below the top edge 52 of walls 26, 28 and thus above bight portion 34. The front edges 54 of slots 50 are spaced rearwardly from front edge 40 of member 20 about 0.187 inches. Nut 22 is selected to have peripheral edge portions 56 which extend at least within slots 50 and preferably beyond walls 26, 28, to be held against rotation when nut 22 is in place. In this regard, nut 22 is received through one of the slots 50 over bight portion 34 and then through the other slot 50 such that lateral edges 56 of nut 22 extend to either side of member 20 (FIG. 2). Screw 24 may then be received through the threaded aperture 58 of nut 22 to tighten down on any conductor 16 inserted between walls 26, 28 (in the direction of arrow B in FIG. 1) to electrically and mechanically secure same thereto.

In accordance with one feature of the present invention, connector member 20 is formed from a generally uniformly thick of single gauge piece 25 of brass, for example, and is then folded into shape. To this end, piece 25 is of sufficient thickness, e.g., about 0.050 inches, to provide the desired characteristics for holding conductor 16, yet may be inexpensively modified to provide the desirably thinner spade lugs 42, 44. Piece 25 may be stamped, for example, to have the shape seen in FIG. 4 with large wings 60 (to define walls 26 and 28) and small wings 62 (from which lugs 42, 44 will be formed).

Figure 3:
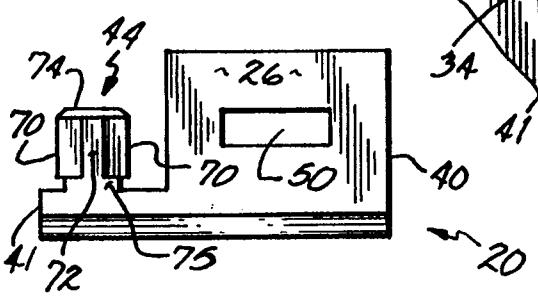
FIG. 3 is a side view of one of the electrical connectors of FIG. 1.

To form member 20, piece is 25 is bent to 30° angles to each side of central axis or bend line 64. Piece 25 is then bent again a further 60° at each secondary bend line 66 so as to define bight walls 36, 38, side walls 26, 28, and upstanding wings 62 which define lugs 42, 44. As will be appreciated, lugs 42, 44 are supported on bight portion 34 and are generally in planes parallel to walls 26, 28 with each lug being generally in the same plane as a respective one of walls 26, 28. However, as initially formed in piece 25, wings 62 are normally about 0.200 inches wide and approximately 0.281 inches tall, and, are of the same thickness as member 20, i.e., 0.050 inches. However, spade lugs are preferably about a quarter inch wide and closer to 0.031 inches thick. To accomplish the desired width and thickness, lateral edges 70 of each wing 62 are coined so as to compress the wing thereat to a thickness of about 0.031 inches, while also extending the edges outwardly so that the wing is overall about 0.250 inches wide. The result is to define the desired width and thickness of lugs 42, 44 and to define generally flat parallel surfaces in the areas of the coining as clearly seen in the Figures.

Where both peripheral edges 70 of a wing 62 are coined, a hump portion 72, about 0.080 inches wide and 0.050 inches thick, is left in place to provide added support to spade lugs 42, 44. The coining preferably extends downwardly from top edge 74 of lugs 42, 44 about 0.250 inches to leave about a 0.031 inch tall support stem 75 (see FIG. 3). Top or distal edge 74 may also be coined to provide a camming edge for spade lug terminal 76 (shown in FIG. 2) to be received thereover.

As conventional spade lug terminals 76 include gripping portions 78 that define an opening or space 79 therebetween to one side of the terminal, they may be slidably received over top edge 74 of a lug 42 or 44 with hump 72 extending into opening 79 and, thus, not interfering with the electrical connection between spade lug 42 or 44 and terminal 76. Alternate coining locations may be selected on wings 62. By way of example, the lateral edge coining may merge into the center of the lug so that no hump remains. Alternatively, only one lateral edge might be coined if a different terminal is used.

By virtue of the foregoing, a simple and quick method is provided for making a power terminal connector of single gauge material and without the time and expense of skiving or milling or the like as was conventional. The coining of the edges 70 and 74 may occur either before or after bending of piece 25 to define member 20, as appropriate or necessary in the manufacturing process.

Figure 5:
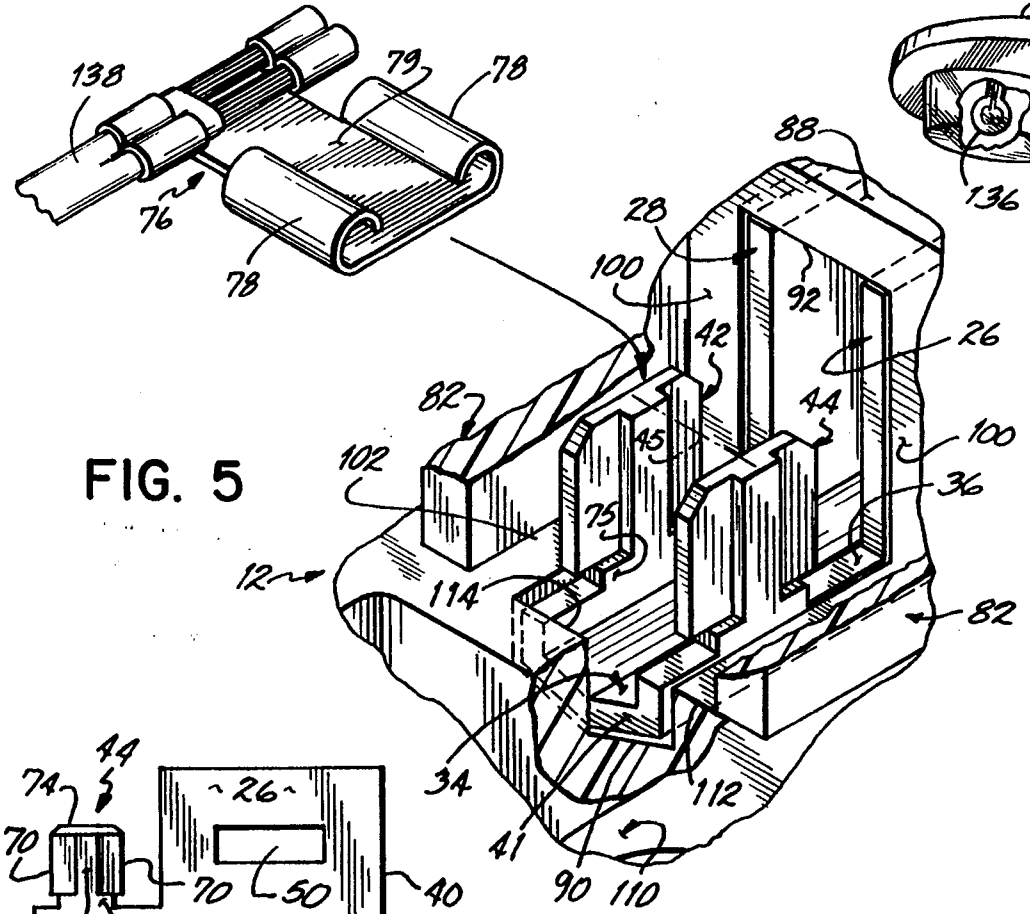
FIG. 5 is a partially broken away perspective view of one passageway of the insulator block housing of FIG. 1.

Insulative terminal block 12 is designed to hold connectors 14. To this end, block 12 is formed of an insulated material such as glass-filled nylon which is injection molded into the form and shape shown in FIGS. 1, 2 and 5. Insulator block housing 12 includes a 1.375 inch (length) by 1.875 inch (width) floor or base wall 80 and a plurality of 1.375 inch (length) by 1.125 inch (height) by 0.094 inch (thick) divider walls 82 perpendicular to floor 80. Each wall 82 is spaced about 0.50 inches from an adjacent wall 82. Situated between each pair of adjacent walls 82 is a connector support portion 84 shaped to match the profile of walls 26, 28 and bight portion 34 of member 20. Connector support portion 84 has a flat front face 86 spaced about 0.156 inches away from front edge 87 of walls 80 and 82. The top surface 88 of each portion 84 is generally parallel to floor 80 and situated approximately 0.166 inches below top edge 89 of walls 82.

Extending into portion 84 from face 86 are passageways 90. Each passageway 90 has a roof 92 spaced about 0.125 inches below top surface 88, an oppositely disposed bight floor 94 (between about 0.577 and 0.655 inches from roof 92), and side walls 96, 98 interconnecting roof 92 and bight floor 94, all shaped and disposed to conform to the shape of walls 26, 28 and bight walls 36, 38 of member 20 to place insulative material against all of these surfaces. To this end, sidewalls 96, 98 are about 0.320 inches apart. Longitudinal grooves 99 (to define a space about 0.40 inch wide) are formed in side walls 96, 98 extending generally parallel to roof 92 and floor 94 to receive peripheral portions 56 of nut 22 therein. Floor 94 extends beyond upper, back face 100 of support portion 84 to expose a portion of passageway 90 at the back end thereof. Roof 92 and sidewalls 96, 98 between faces 86 and 100 are sized and situated to conform to and confine walls 26, 28 of connector 14. Thus, roof 92 and the upper portion of sidewalls 96, 98 extend about 0.772 inches from face 86. The lower about 0.116 inch high portions of sidewalls 96, 98 and bight floor 94 continue about 0.447 inches beyond back face 100 to confine the back end of bight portion 34 supporting spade lugs 40, 42 with lugs 40, 42 extending above sidewalls 96, 98 into the exposed portion of passageway 90 as at 102.

Figure 6:
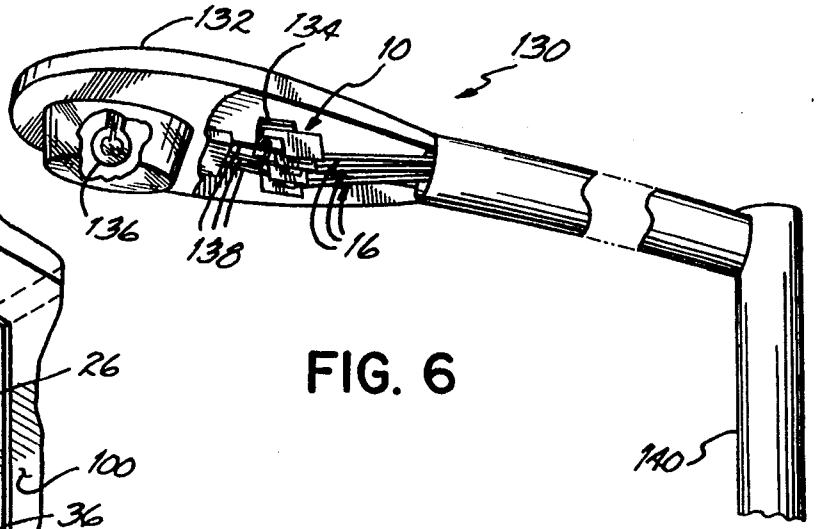
FIG. 6 is a diagrammatic representation of an electrical street light assembly, including the main power terminal block of FIG. 1, for purposes of explaining the principles of the present invention.

Structure 110 is formed along the back edge 112 of sidewalls 96, 98 and bight floor 94 to place or define a limit wall 114 (about 0.197 inches high from the bottom of bight floor 94 or about 0.375 inch high from base wall 80) at the back end of passageway 90. Thus, when a connector 14 is inserted into a passageway 90, spade lug-end first, through face 86 the extent of travel of the connector will be limited so that walls 26, 28 (and nut 22) will be confined within passageway 90 below roof 92 and spade lugs 40, 42 will be accessible in the exposed region at 102 between divider walls 82. Spaced about 0.536 inch rearwardly of front edges 87 are apertures 116 which extend through top surface 88 and roof 92 of each support portion 84. Apertures 116 are along the longitudinal axis of passageways 90 to be aligned with hole 58 of nuts 22. A bolt 24 may be received through an aperture 116 and into nut 22 to hold connector 14 within the passageway and to secure conductor 16 within member 20. Recessed through-bores 118 may be formed in extended tabs 120 of structure 110 by which to mount insulator block 12 to a street light assembly 130 (FIG. 6) such as with screws (not shown).

In use, each connector 14 is made by forming and coining piece 25 into member 20 as above-described. Once shaped and formed, nut 22 is inserted through slots 50 and the two pieces are then slid, spade lug-end first, into a passageway 90 through front face 86 of insulator 12 (along the direction of arrow C in FIG. 1) until distal end 41 of member 20 rests against limit wall 114. In this position, hole 58 of nut 22 is aligned with aperture 116 in roof 92. Bolt 24 is then inserted through aperture 116 and threaded into hole 58 of nut 22 to secure connector 14 to housing block 12. The above is repeated for each of the electrical connectors. Once they are all in place, main power terminal block 10 may be attached to the electric street light assembly 130.

To this end, street light assembly 130 includes a two-part shell 132 (FIG. 6) containing therein a mounting bracket 134 or the like. Block 10 is secured to bracket 134 and the light electric circuitry 136 connected via wires 138 to spade lug terminals 76. Each terminal 76 is slid over a respective spade lug 42, 44 of connectors 14. Circuitry 136 also connects to a light source 138 within shell 132 to provide the desired street lighting.

Street light assembly 130 may be mounted atop a pole 140 as is conventional which pole 140 is secured to a base (not shown) on the ground, for example. Electrical power conductors 16 run through the interior of pole 140, for example, and may be passed into the shell of street light assembly 130. Each conductor 16 is stripped to expose wires 15 and inserted between walls 26, 28 of a respective connector 14. Bolt 24 of the connectors is then tightened down to mechanically and electrically secure conductor 16 therein whereby to provide power to wiring 138 for powering street light assembly 130.

While the present invention has been illustrated by the description of an embodiment of the invention, and while the embodiment has been described in considerable detail, it is not intended to restrict or in any way limit the scope of the appended claims to such detail. Additional advantages and modifications will readily appear to those skilled in the art. For example, nut 22 could be some other nut-like structure by which to effectively provide a stable threaded aperture to receive bolt 24. The invention in its broader aspects is therefore not limited to the specific details, representative apparatus and method and illustrative examples shown and described. Accordingly, departures may be made from such details without departing from the scope or spirit of applicants' general inventive concept.

Having described the invention, what is claimed is:

1. A method of forming an electrical connector for a main power terminal block of a street light assembly from a piece of generally uniformly thick metal comprising:

adapting a first portion of the metal piece to receive a power conductor;

shaping a second portion of the metal piece into a wing having a thickness of the metal piece, that thickness being greater than a desired thickness to receive a terminal thereover; and coining at least a portion of the wing to define generally flat parallel surfaces and to reduce the thickness thereof to about the desired thickness whereby to receive said terminal thereover.

2. The method of claim 1 wherein the portion being coined includes a lateral edge portion of the wing.

3. The method of claim 1 wherein the portion of the wing being coined includes opposed lateral edges of the wing.

4. The method of claim 3 further comprising stiffening the wing by leaving a hump portion having the thickness of the metal piece between the lateral edges after coining.

5. The method of claim 3 further wherein after coining a hump portion having the thickness of the metal piece remains between the lateral edges.

6. The method of claim 1 further comprising coining a distal top edge of the wing to facilitate receiving said terminal thereover.

7. The method of claim 1 wherein adapting the first portion includes shaping the metal piece into a generally U-shaped cross-section having spaced apart walls supported on a bight portion for receiving a power conductor therebetween.

8. The method of claim 7 further comprising providing slots in the walls above the bight portion to receive a nut-like member therethrough with a threaded aperture overlying the bight portion.

9. A method of forming an electrical connector for a main power terminal block of a street light assembly from a piece of generally uniformly thick metal comprising:

adapting a first portion of the metal piece to receive a power conductor;

shaping a second portion of the metal piece into a wing having a thickness of the metal piece, that thickness being greater than a desired thickness to receive a terminal thereover, the wing having an overall width less than a desired width; and coining at least a portion of the wing to define generally flat parallel surfaces and to reduce the thickness thereof to about the desired thickness and increase the overall width of the wing to about the desired width whereby to receive said terminal thereover.

10. The method of claim 9 wherein the portion being coined includes a lateral edge portion of the wing.

11. The method of claim 9 wherein the portion of the wing being coined includes opposed lateral edges of the wing.

12. The method of claim 11 further comprising stiffening the wing by leaving a hump portion having the thickness of the metal piece between the lateral edges after coining.

13. The method of claim 11 further wherein after coining a hump portion having the thickness of the metal piece remains between the lateral edges.

14. The method of claim 9 further comprising coining a distal top edge of the wing to facilitate receiving said terminal thereover.

15. The method of claim 9 wherein adapting the first portion includes shaping the metal piece into a generally U-shaped cross-section having spaced apart walls supported on a bight portion for receiving a power conductor therebetween.

16. The method of claim 15 further comprising providing slots in the walls above the bight portion to receive a nut-like member therethrough with a threaded aperture overlying the bight portion.

17. A method of making an electrical connector comprising:

shaping a portion of a single piece of generally uniform gauge material into a pair of upstanding walls and a bight supporting the walls, the walls being spaced apart to confine an electrical conductor therebetween;

forming from the piece at least one spade lug having an initial width and initially, due to the gauge of the piece, being of a thickness larger than desired; and coining at least a peripheral portion of the lug to define generally flat parallel surfaces and to reduce the thickness thereat to about the desired thickness.

18. The method of claim 17 wherein the initial width of the spade lug is smaller than desired, and wherein coining further extends the width of the wing to about the desired width.

19. The method of claim 17 further comprising slotting the walls at a location elevated from the bight.

20. The method of claim 19 further comprising inserting a nut-like member through the slots such that an apertured hole thereof is between the walls and above the bight.

21. The method of claim 20 further comprising threadably inserting a threaded member into the nut-like member to electrically and mechanically secure a power conductor situated between the walls, bight and nut-like member.

22. The method of claim 17 further comprising supporting the spade lug on the bight.

23. An electrical connector for a main power terminal block of a street light assembly comprising:

a piece of generally uniformly thick metal having a first portion adapted to receive a power conductor, and a second portion shaped into a wing initially having a thickness of the metal piece, that thickness being greater than a desired thickness to receive a terminal thereover, the second portion being coined over at least a portion of the wing to define generally flat parallel surfaces and to reduce the thickness thereof to about the desired thickness whereby to receive said terminal thereover.

24. The electrical connector of claim 23 wherein the portion of the wing being coined includes a lateral edge portion of the wing.

25. The electrical connector of claim 23 wherein the portion of the wing being coined includes opposed lateral edges of the wing.

26. The electrical connector of claim 25 further comprising, between the lateral edges, a hump portion on the wing, the hump portion having the thickness of the metal piece.

27. The electrical connector of claim 23 wherein the first portion has a generally U-shaped cross-section and includes a pair of spaced apart walls supported on a bight portion for receiving a power conductor therebetween.

28. The electrical connector of claim 27 further comprising slots in the walls spaced from the bight portion and sized to non-rotatably receive a nut-like member therethrough with a threaded aperture overlying the bight portion.

29. The electrical connector of claim 28 further including the nut-like member within the slots, and a threaded member threadably received through the nut-like member aperture.

30. An electrical connector comprising:

a single piece of generally uniform gauge material having a pair of upstanding walls and a bight supporting the walls, the walls being spaced apart to confine an electrical conductor therebetween, the piece further having at least one spade lug having an initial width and initially, due to the gauge of the piece, being of a thickness larger than desired, the spade lug being coined over at least a peripheral portion of the lug to define generally flat parallel surfaces and to reduce the thickness thereat to about the desired thickness.

31. The electrical connector of claim 30 wherein the initial width is smaller than desired and wherein the coined lug has a width about equal to the desired width.

32. The electrical connector of claim 30 further comprising slots through the walls at a location elevated from the bight.

33. The electrical connector of claim 32 further comprising a nut-like member inserted through the slots such that an apertured hole thereof is between the walls and above the bight.

34. The electrical connector of claim 33 further comprising a threaded member threadably inserted into the nut-like member to electrically and mechanically secure any wires situated between the walls, bight and nut-like member.

35. An electrical connector comprising:

a generally U-shaped metal member defined by a pair of upstanding walls and a bight portion supporting the walls, the walls being spaced apart to confine an electrical wire therebetween;

at least one spade lug extending from the metal member and sized to receive thereover an electrical terminal wherein the spade lug includes a coined peripheral portion defining generally flat parallel surfaces;

a nut-like member having a threaded aperture being supported by the upstanding walls above the bight portion;

a threaded member extending through the threaded aperture of the nut-like member between the walls and towards the bight portion whereby to facilitate firmly and electrically securing a wire to the electrical connector.

36. The electrical connector of claim 35 wherein the coined peripheral portion of the spade lug includes opposed lateral edges.

37. The electrical connector of claim 36, the spade lug further including a hump portion between the opposed lateral edges.

38. The electrical connector of claim 35, the spade lug including a coined camming edge.

39. The electrical connector of claim 35 wherein the bight portion extends beyond the walls, the spade lug being supported on the bight portion.

40. The electrical connector of claim 39 wherein the spade lug extends from the bight portion in a plane generally parallel with the upstanding walls.

41. An insulator block for electrical connectors adapted to secure wires thereto by operation of a threaded member wherein the electrical connectors each include a generally U-shaped portion defined by a pair of upstanding walls and a bight portion extending beyond said upstanding walls to support along a distal end of said bight portion spade lugs for electrical connection to spade lug terminals and a nut-like member for threadably receiving the threaded member, the insulator block comprising:

a non-conductive housing;

a plurality of passageways extending into the housing, each passageway being sized to receive therein one of said electrical connectors and being defined between opposed floors and roofs with sidewalls extending therebetween;

the roof associated with each passageway including hole means communicating with the passageway in alignment with the nut-like member for receiving said threaded member therethrough and into said nut-like member whereby to hold said electrical connector in the passageway, at least the roofs of each passageway terminating into an exposed portion of the housing whereat said electrical connector spade lugs are to be positioned whereby to permit access to said spade lugs for connection to said spade lug terminals.

42. The insulator block of claim 41 wherein the housing further includes insulating divider walls to either side of each passageway in the exposed portion of the housing.

43. The insulator block of claim 41 wherein each said nut-like member extends through a slot in said upstanding walls of a said connector for threadably receiving said threaded member, at least one sidewall of each passageway including a groove therein into which said nut-like member fits when said electrical connector is received in the passageway.

44. The insulator block of claim 41 wherein the housing includes a a support portion between each pair of adjacent sidewalls, each support portion including a respective one of the passageways.

45. The insulator block of claim 44 wherein the support portion is defined below and away from the edges of the sidewalls.

46. The insulator block of claim 41 wherein the passageways also terminate into structure extending adjacent the passageway floors to provide a partial back wall to the passageways whereby to limit insertion of said electrical connectors into the passageways.

* * * * *